US010097927B2

(12) United States Patent
Rusconi Clerici Beltrami et al.

(10) Patent No.: US 10,097,927 B2
(45) Date of Patent: Oct. 9, 2018

(54) LOUD SPEAKER ARRANGEMENT WITH CIRCUIT-BOARD-INTEGRATED ASIC

(71) Applicant: USound GmbH, Graz (AT)

(72) Inventors: Andrea Rusconi Clerici Beltrami, Hamburg (DE); Ferruccio Bottoni, Graz (AT)

(73) Assignee: USOUND GMBH, Graz (AT)

( * ) Notice: Subject to any disclaimer, the term of this patent is extended or adjusted under 35 U.S.C. 154(b) by 0 days.

(21) Appl. No.: 15/306,203

(22) PCT Filed: Apr. 24, 2015

(86) PCT No.: PCT/EP2015/058898
§ 371 (c)(1),
(2) Date: Oct. 24, 2016

(87) PCT Pub. No.: WO2015/162248
PCT Pub. Date: Oct. 29, 2015

(65) Prior Publication Data

US 2017/0048624 A1 Feb. 16, 2017

(30) Foreign Application Priority Data

Apr. 24, 2014 (DE) ..... 10 2014 105 754

(51) Int. Cl.
*H04R 19/02* (2006.01)
*H04R 3/00* (2006.01)

(52) U.S. Cl.
CPC ..... *H04R 19/02* (2013.01); *H04R 3/00* (2013.01); *H04R 2201/003* (2013.01)

(58) Field of Classification Search
None
See application file for complete search history.

(56) References Cited

U.S. PATENT DOCUMENTS 6,324,067 B1 11/2001 Nishiyama
7,825,509 B1 11/2010 Baumhauer, Jr. et al.
(Continued)

FOREIGN PATENT DOCUMENTS

DE 102011084393 A1 4/2013
DE 102011086722 A1 5/2013
(Continued)

OTHER PUBLICATIONS

PCT Search Report, dated Apr. 24, 2014.
Translation of International Preliminary Report on Patentability, dated Oct. 25, 2016.

*Primary Examiner* — Curtis Kuntz
*Assistant Examiner* — Qin Zhu
(74) *Attorney, Agent, or Firm* — Dorrity & Manning, P.A.

(57) ABSTRACT

A loudspeaker array includes a MEMS loudspeaker with a diaphragm deflectable along a Z axis; a printed circuit board having a first cavity housing an ASIC electrically connected to the MEMS loudspeaker; and a sound-conducting channel disposed adjacent to the MEMS loudspeaker and having an acoustic outlet opening. The printed circuit board includes a second cavity having an opening, which is closed by the MEMS loudspeaker, so that the second cavity forms at least a part of a cavity of the MEMS loudspeaker. The sound-conducting channel extends at an angle to the Z axis of the MEMS loudspeaker. The acoustic outlet opening is arranged on a side face of the loudspeaker array.

18 Claims, 4 Drawing Sheets

(56) References Cited

U.S. PATENT DOCUMENTS

| | | | | |
|---|---|---|---|---|
| 8,618,619 | B1 | 12/2013 | Miks et al. | |
| 2002/0102004 | A1 | 8/2002 | Minervini | |
| 2005/0233781 | A1* | 10/2005 | Erixon | H04M 1/035 455/575.1 |
| 2009/0101998 | A1* | 4/2009 | Yen | H04R 31/00 257/416 |
| 2010/0061055 | A1* | 3/2010 | Dabov | G06F 1/1626 361/679.56 |
| 2011/0158453 | A1* | 6/2011 | Tanaka | H04R 19/04 381/361 |
| 2012/0223620 | A1* | 9/2012 | Buccafusca | G10K 11/025 310/335 |
| 2012/0269373 | A1* | 10/2012 | Slotte | H04M 1/035 381/353 |
| 2013/0001550 | A1* | 1/2013 | Seeger | G01L 5/223 257/48 |
| 2013/0121509 | A1 | 5/2013 | Hsu et al. | |
| 2013/0126991 | A1 | 5/2013 | Ehrenpfordt et al. | |
| 2013/0193533 | A1 | 8/2013 | Vos et al. | |
| 2013/0221455 | A1* | 8/2013 | Manack | B81C 1/00246 257/416 |
| 2014/0044297 | A1* | 2/2014 | Loeppert | H04R 1/04 381/355 |
| 2014/0361388 | A1* | 12/2014 | Chan | B81B 3/0021 257/416 |
| 2015/0001653 | A1* | 1/2015 | Schelling | B81C 1/00158 257/419 |
| 2015/0078590 | A1 | 3/2015 | Daley et al. | |

FOREIGN PATENT DOCUMENTS

| | | | |
|---|---|---|---|
| DE | 102012220819 | A1 | 5/2013 |
| WO | WO 2013/152899 | A1 | 10/2013 |

* cited by examiner

LOUD SPEAKER ARRANGEMENT WITH CIRCUIT-BOARD-INTEGRATED ASIC

FIELD OF THE INVENTION

The present invention relates to a loudspeaker array comprising a printed circuit board, a MEMS loudspeaker for generating sound waves in the audible wavelength range and an ASIC, which is electrically connected to the MEMS loudspeaker.

The term MEMS stands for micro-electromechanical systems. A MEMS-based loudspeaker or, more specifically, a micro speaker is known, for example, from the German patent DE 10 2012 220 819 A1. The sound generation is effected by means of a diaphragm of the MEMS loudspeaker, with the diaphragm being mounted in such a manner that it can oscillate. A micro speaker of this type typically needs to generate a high air volume displacement in order to gain a significant sound pressure level. Known MEMS loudspeakers have the disadvantage that they have a relatively large space requirement.

The primary object of the present invention is to provide a loudspeaker array that is designed such that it is very compact.

SUMMARY OF THE INVENTION

The aforementioned object is achieved by means of a loudspeaker array exhibiting the features disclosed in the description below.

Proposed is a loudspeaker array for MEMS loudspeakers, which lend themselves to generating sound waves in the audible wavelength range. The loudspeaker array comprises a printed circuit board, a MEMS loudspeaker and an ASIC. The MEMS loudspeaker is a micro-electromechanical system for generating sound waves in the audible wavelength range. The MEMS loudspeaker has a diaphragm that can be deflected in a Z axis of the MEMS loudspeaker. Preferably the MEMS loudspeaker is driven by electro-mechanical means, electrostatic means and/or piezo-electric means. The MEMS loudspeaker is electrically connected to the ASIC.

The printed circuit board has a first circuit board cavity, which is, in particular, more or less closed. The ASIC is disposed in this first circuit board cavity. Thus, the ASIC is completely integrated into the printed circuit board. As a result, the ASIC, which is protected against external influences, is accommodated in the interior of the first circuit board cavity of the printed circuit board. The printed circuit board has a second circuit board cavity. The second circuit board cavity comprises an opening. The MEMS loudspeaker extends over the opening of the second circuit board cavity in such a way that the opening is completely closed by means of said MEMS loudspeaker. Furthermore, the MEMS loudspeaker extends over the opening in such a way that the second circuit board cavity forms at least a part of a cavity of the MEMS loudspeaker. The term "cavity" is defined as a cavity, by means of which the sound pressure of the MEMS loudspeaker can be increased.

If the ASIC is fully integrated into the printed circuit board and at the same time the printed circuit board forms at least partially the cavity of the MEMS loudspeaker, then the loudspeaker array may be designed such that it is very compact. The loudspeaker array has a sound-conducting channel. The sound-conducting channel is disposed adjacent to the MEMS loudspeaker. Thus, the sound, generated by the MEMS loudspeaker, is carried away via the sound-conducting channel. On its end facing away from the MEMS loudspeaker, the sound-conducting channel has an acoustic outlet opening. This acoustic outlet opening allows the sound, which is generated, to leave the loudspeaker array. The sound-conducting channel extends at an angle, in particular, at a 90°-angle, to the Z axis of the MEMS loudspeaker. The acoustic outlet opening is arranged on a side face of the loudspeaker array. The side face is aligned preferably parallel to the Z axis; and/or the surface normal of the side face is aligned preferably perpendicular to the Z axis.

It is advantageous if the printed circuit board has a third circuit board cavity, in which the MEMS loudspeaker is disposed at least partially. This aspect allows the MEMS loudspeaker to be at least partially integrated into the printed circuit board in a form-fitting manner, with the result that the space requirement of the loudspeaker array is reduced. Preferably the third circuit board cavity is arranged in such a way that it is, in particular, immediately adjacent to the second circuit board cavity. Furthermore, the third circuit board cavity is preferably formed, in particular, directly in the region of the opening of the second circuit board cavity. Furthermore, the MEMS loudspeaker is fixed, in particular, in a form-fitting manner in the printed circuit board. In addition, the MEMS loudspeaker can be securely connected to the printed circuit board by material bonding, in particular, by adhesively cementing, and/or in a force fitting manner, in particular, by pressing into said printed circuit board.

In an advantageous further development of the invention the MEMS loudspeaker is preferably completely integrated into and/or embedded in the printed circuit board. This integration of the MEMS loudspeaker into the printed circuit board is configured preferably in such a way that the third circuit board cavity envelops in a form-fitting manner the MEMS loudspeaker in the edge region of said third circuit board cavity, preferably in the manner of a frame and/or in the region of its side facing the second circuit board cavity and/or its side facing away from the second circuit board cavity. As a result, during the layerwise production of the printed circuit board the MEMS loudspeaker can be integratively and securely connected to said printed circuit board. This feature allows the manufacturing process of the loudspeaker array to be designed in such a way that it is very easy and cost-effective.

In order to amplify the sound, generated by the MEMS loudspeaker, and/or to be able to guide the sound, generated by the MEMS loudspeaker, in one direction or, more specifically, to one side of the loudspeaker array, it is advantageous if the loudspeaker array has a sound-conducting channel that is, in particular, immediately adjacent to the third circuit board cavity. Preferably the sound-conducting channel is formed at least partially by a fourth circuit board cavity of the printed circuit board. This feature offers the advantage that no additional components are needed to form the sound-conducting channel. Furthermore, this feature allows the loudspeaker array to be designed in a very space-saving manner.

In addition, it is also advantageous if the sound-conducting channel has an acoustic outlet opening in the direction of an outer face, in particular, in the direction of an installation-oriented top side and/or in the direction of a side face, of the loudspeaker array, in particular, the printed circuit board. From this outlet opening the sound that is generated by the MEMS loudspeaker can exit the loudspeaker array, in particular, the printed circuit board.

It is advantageous if the printed circuit board has a fourth circuit board cavity. This fourth circuit board cavity forms preferably at least partially the sound-conducting channel.

This feature allows the loudspeaker array to be designed in a very compact and cost-effective way.

In order to securely fix the MEMS loudspeaker in the printed circuit board, it is advantageous if the third circuit board cavity has a greater width than the second and/or fourth circuit board cavity/cavities in order to envelop the MEMS loudspeaker in a form-fitting manner. In addition to this form-fitting fixing of the MEMS loudspeaker, said MEMS loudspeaker may be optionally fixed by material bonding and/or in a force fitting manner in the third circuit board cavity, which can also be designed as a circuit board recess on an outer face of the printed circuit board.

It is advantageous if the width of the sound-conducting channel, in particular, the fourth circuit board cavity, increases at least in regions, in particular, starting from the MEMS loudspeaker and/or the third circuit board cavity, in the direction of the outlet opening. This increase in width is designed preferably in the shape of a funnel.

The MEMS loudspeaker faces preferably an outer face, in particular, an installation-oriented top side of the loudspeaker array and/or the printed circuit board. In order to be able to direct the sound, generated by the MEMS loudspeaker, in a direction that deviates from the orientation of the MEMS loudspeaker as installed, it is advantageous if the sound-conducting channel, in particular, the fourth circuit board cavity, has a first region and a second region. In this case the first region is arranged preferably adjacent to the MEMS loudspeaker. The second region is arranged, in particular, adjacent to the outlet opening. In order to direct the sound in a direction that is independent of the orientation of the MEMS loudspeaker, it is advantageous if the first and second regions are inclined at an angle with respect to each other. For this purpose the sound-conducting channel may be curved and/or bent. The angular inclination of the two regions is preferably 90°. As a result, the MEMS loudspeaker can be oriented toward a top side or bottom side of the loudspeaker array, in particular, the printed circuit board, where in this case the sound that is generated can exit in another region, in particular, on a side face of the printed circuit board.

A very compact design of the loudspeaker array can be effected, if the MEMS loudspeaker is fully integrated into the printed circuit board and the printed circuit board forms at least partially the cavity and the sound-conducting channel. For this purpose it is advantageous if the second and fourth circuit board cavities are spaced apart from each other by means of the third circuit board cavity. Furthermore, it is advantageous if the second and fourth circuit board cavities are separated from each other by means of the MEMS loudspeaker that is integrated into the third circuit board cavity.

In an advantageous further development of the invention the MEMS loudspeaker comprises a carrier substrate; a substrate cavity, which is formed in the carrier substrate; and a diaphragm. In this case the carrier substrate forms preferably a frame. For this purpose the substrate cavity has a first and second substrate opening, in particular, on two opposite sides of the carrier substrate. Hence, the frame-shaped carrier substrate is preferably open toward a top side and a bottom side of the MEMS loudspeaker. One of these two substrate openings, in particular, the first substrate opening, is spanned by means of the diaphragm, which is preferably connected in its edge region to the carrier substrate, in such a way that the diaphragm can oscillate in relation to the carrier substrate in order to generate sound energy.

In order to form a cavity that is as large as possible, it is advantageous if the MEMS loudspeaker is oriented in comparison to the printed circuit board in such a way that the substrate cavity and the second circuit board cavity together form the cavity of the MEMS loudspeaker. This arrangement also allows the volume of the cavity, which is formed at least by the second circuit board cavity, to be increased by means of the volume of the substrate cavity. For this purpose the second substrate opening of the MEMS loudspeaker is preferably oriented toward the second circuit board cavity.

It is also advantageous if the MEMS loudspeaker is oriented with respect to the printed circuit board in such a way that the substrate cavity forms at least partially the sound channel, in particular, together with the fourth circuit board cavity. As a result, the loudspeaker array can be designed such that it is very compact. In this respect it is advantageous if the second substrate opening faces away from the second circuit board cavity.

The loudspeaker array can be produced very easily and cost-effectively, if the printed circuit board is constructed like a sandwich of several layers that are arranged one on top of the other and/or are connected to each other, preferably by material bonding.

In order to design the ASIC, the cavity, the MEMS loudspeaker and/or the sound-conducting channel such that they are integrated into the printed circuit board, it is advantageous if at least one of these layers has a first recess, by means of which the first circuit board cavity is formed at least partially, in order to receive the ASIC in an embedded manner. In addition or as an alternative, it is also advantageous if at least one of these layers has a second recess, by means of which the second, third and/or fourth circuit board cavity/cavities is/are formed at least partially.

Preferably the printed circuit board comprises a plurality of stacked layers having such a first and/or second recess, so that the circuit board cavity, which is formed by means of said first and/or second recess, has a correspondingly sufficient volume, in particular, sufficient height that the ASIC can be disposed therein. Furthermore, this feature makes it possible for the respective circuit board cavity to be designed such that it has a correspondingly sufficient volume to receive the MEMS loudspeaker.

It is advantageous if the second circuit board cavity forms together with the third and/or fourth circuit board cavity/cavities a common acoustic cavity, which is divided by means of the MEMS loudspeaker into the cavity and at least one part of the sound-conducting channel.

In order to make the loudspeaker array as flat as possible, it is advantageous if the first and second circuit board cavities, in particular, the first and second recesses, are arranged side by side. Furthermore, it is advantageous if the first and second circuit board cavities are separated from each other. In order to be able to make the loudspeaker array as narrow as possible, it is also advantageous as an alternative, if the first and second circuit board cavities are arranged one on top of the other and/or are separated from each other, in particular, by means of a layer.

In order to generate sound waves, the diaphragm oscillates in the Z direction at least partially into the second and/or fourth circuit board cavity/cavities. In order to equalize the pressure, it is advantageous if the printed circuit board has at least one pressure equalization channel. This pressure equalization channel connects the second circuit board cavity to an outer face of the loudspeaker array. The pressure equalization channel extends preferably from the second circuit board cavity up to an outer face of the loudspeaker array, in particular, the printed circuit board.

Furthermore, this pressure equalization channel has preferably an equalization opening on at least one of the outer faces of the loudspeaker array, in particular, the printed circuit board, preferably a side face, a bottom side and/or a top side.

It is advantageous if the pressure equalization channel has a first section, which is connected, in particular, to the second circuit board cavity, and a second section, which is connected, in particular, to the equalization opening; and both the first and second sections are connected to each other and are preferably inclined with respect to each other at an angle, in particular, of 90°. Preferably the two sections are connected together by way of an elbow or a bend. Therefore, depending on the installation situation of the loudspeaker array, the equalization opening can be disposed in an optimum region on one of the outer faces of the loudspeaker array, in particular, the printed circuit board.

Furthermore, the invention proposes a loudspeaker array, which is preferably designed in accordance with the foregoing description, where in this case the aforementioned features may be present individually or in any combination. The loudspeaker array comprises a printed circuit board, a MEMS loudspeaker for generating sound waves in the audible wavelength range and an ASIC that is electrically connected to the MEMS loudspeaker. The printed circuit board comprises a first circuit board cavity, in which the ASIC is disposed so as to be completely integrated into the printed circuit board. The printed circuit board has a second circuit board cavity with an opening, which is closed by means of the MEMS loudspeaker. As a result, the second circuit board cavity forms at least a part of a cavity of the MEMS loudspeaker. The printed circuit board has at least one pressure equalization channel. Hence, the pressure equalization channel is formed at least partially in the printed circuit board or, more specifically, is integrated therein. Said pressure equalization channel extends from the second circuit board cavity, in particular, from the cavity, up to an outer face of the loudspeaker array.

It is advantageous if the pressure equalization channel has an equalization opening in order to equalize the pressure with the surrounding area. This equalization opening is arranged preferably on the outer face, preferably a side face, a bottom side and/or a top side, of the loudspeaker array, in particular, the printed circuit board. The equalization opening is arranged preferably on the end of the pressure equalization channel that faces away from the cavity.

It is advantageous if the pressure equalization channel has a first section, which is connected, in particular, to the second circuit board cavity, and/or a second section, which is connected, in particular, to the equalization opening. Preferably these two sections are arranged at an angle to each other. As a result, in particular, an elbow is formed between them. The two regions are preferably inclined with respect to each other at an angle of, in particular, 90°.

BRIEF DESCRIPTION OF THE DRAWINGS

Additional advantages of the invention are described in the following exemplary embodiments. The drawings show in.

DETAILED DESCRIPTION

Figure 1:
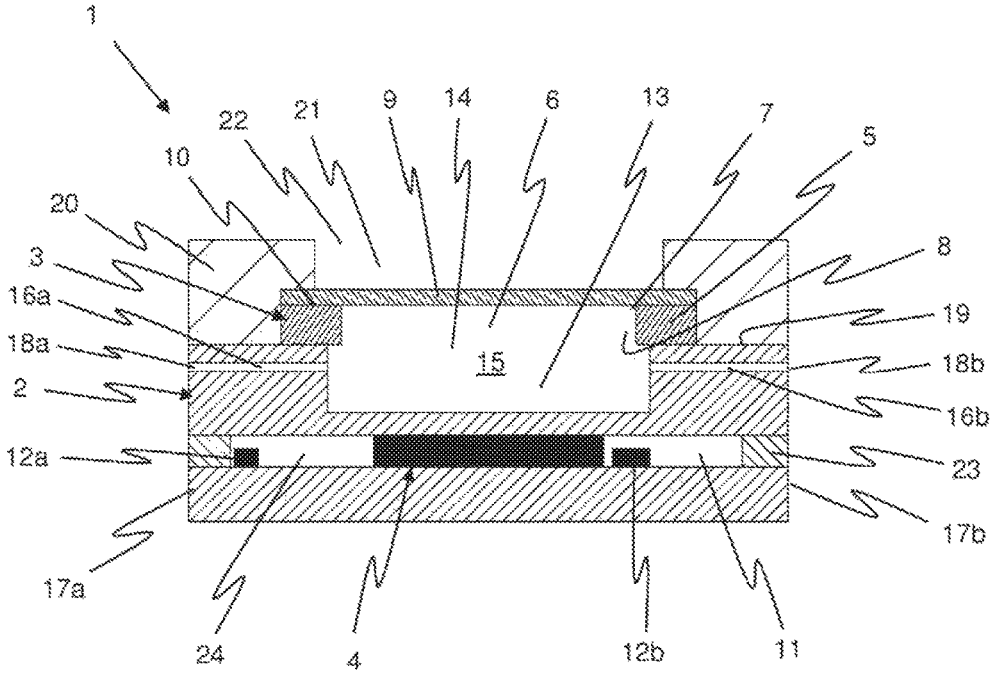
FIG. 1 a first exemplary embodiment of the loudspeaker array in a sectional view, wherein the loudspeaker array comprises an ASIC, which is integrated into the printed circuit board, and a cavity, which is integrated into the printed circuit board, FIG. 2 a second exemplary embodiment of the loudspeaker array in a sectional view, wherein the loudspeaker array comprises an ASIC, which is integrated into the printed circuit board, and a cavity, which is integrated into the printed circuit board, and a MEMS loudspeaker, which is integrated into the printed circuit board, FIG. 3 a third exemplary embodiment of the loudspeaker array in a sectional view, wherein the loudspeaker array comprises an ASIC, which is integrated into the printed circuit board, and a cavity, which is integrated into the printed circuit board, a MEMS loudspeaker, which is integrated into the printed circuit board, and a sound-conducting channel, which is integrated into the printed circuit board, FIG. 4 a fourth exemplary embodiment of the loudspeaker array in a sectional view with an alternative orientation of the MEMS loudspeaker and an alternative embodiment of a pressure equalization channel, FIG. 5 a fifth exemplary embodiment of the loudspeaker array in a sectional view with an alternative embodiment of the sound-conducting channel, FIG. 6 a sixth exemplary embodiment of the loudspeaker array in a sectional view with an alternative embodiment of the MEMS loudspeaker, and FIG. 7 a seventh exemplary embodiment of the loudspeaker array in a sectional view with an alternative embodiment of the second circuit board cavity.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

In the following description of the figures terms are used to define the relationships between the various elements that relate to the position of each object depicted in the figures, such as, for example, above, below, up, down, over, under, left, right, vertically and horizontally. Of course, it goes without saying that these terms may change in the case of a deviation from the position of the devices and/or elements depicted in the figures. Thus, for example, if an orientation of the devices and/or elements shown in the figures is inverted, then a feature that is specified as "above" in the following description of the figures would now be arranged "below," Hence, the relative terms that are applied are used merely for the sake of simplifying the description of the relative relationships between the individual devices and/or elements described below. In the exemplary embodiments shown in the figures a Z axis of a MEMS loudspeaker, in the direction of which a diaphragm of the MEMS loudspeaker can oscillate, extends vertically or, more specifically, between the top side and the bottom side of the loudspeaker array.

FIG. 1 shows a first exemplary embodiment of a loudspeaker array 1 in a lateral sectional view. The loudspeaker array 1 comprises in essence a printed circuit board 2, a MEMS loudspeaker 3 and an ASIC 4. The MEMS loudspeaker 3 is connected to the ASIC 4 with electrical contacts that are not shown in more detail in the figures. As a result, the MEMS loudspeaker 3 can be controlled by means of the ASIC 4.

The MEMS loudspeaker 3 is designed in such a way that it can generate sound waves in the audible wavelength range. To this end, the MEMS loudspeaker 3 comprises a carrier substrate 5. The carrier substrate 5 has at least one substrate cavity 6. The substrate cavity 6 has in turn a first, figure-oriented top substrate opening 7 and a second, figure-oriented bottom substrate opening 8 in the region of two opposite sides of the carrier substrate 5. Thus, the carrier substrate 5 forms a frame. Furthermore, the MEMS loudspeaker 3 comprises a diaphragm 9. This diaphragm 9 is securely connected to the carrier substrate 5 in the edge region 10 of the carrier substrate 5. As a result, the diaphragm 9 spans the frame-shaped carrier substrate 5 in the region of the first substrate opening 7. The MEMS loudspeaker 3 can be excited by means of the ASIC 4 in such a way that the diaphragm 9 is made to oscillate in relation to the carrier substrate 5 in order to generate sound energy.

According to FIG. 1, the printed circuit board 2 has a first circuit board cavity 11. The first circuit board cavity 11 is more or less completely closed. The ASIC 4 is disposed in the first circuit board cavity 11. As a result, the ASIC 4 is completely embedded in the printed circuit board 2.

In addition to the ASIC 4, the loudspeaker array 1 has electrical, in particular, passive, additional components 12*a*, 12*b*. These electronic additional components 12*a*, 12*b* are also embedded in the printed circuit board 2. For this purpose these additional components are arranged, according to the exemplary embodiment shown in FIG. 1, in the same first circuit board cavity 11. As an alternative, however, the first circuit board cavity 11 could also comprise a plurality of circuit board cavities that are separated from each other, where in this case an electronic component, i.e., the ASIC 4 and/or an additional component 12*a*, 12*b*, could be disposed separately in each circuit board cavity. That being the case, it is advantageous if these circuit board cavities are arranged in a plane of the loudspeaker array 1.

In addition to the first circuit board cavity 11, the printed circuit board 2 comprises a second circuit board cavity 13. The second circuit board cavity 13 has an opening 14. This opening 14 is closed by the MEMS loudspeaker 3. To this end the MEMS loudspeaker 3 extends over at least the entire width of the opening 14. As a result, the second circuit board cavity 13 forms a part of a cavity 15 of the MEMS loudspeaker 3. The cavity 15 is used to increase the sound pressure of the MEMS loudspeaker 3. Due to the installation position of the MEMS loudspeaker 3 the other part of the cavity 15 is formed by means of the substrate cavity 6 of the MEMS loudspeaker 3. As a result, the cavity 15 of the MEMS loudspeaker 3 is designed in accordance with the exemplary embodiment shown in FIG. 1 such that it is very large, since it is formed by means of both the second circuit board cavity 13 and also by means of the substrate cavity 6.

In order to be able to ensure a pressure equalization between the cavity 15 and the surrounding area when the diaphragm 9 is oscillating, the loudspeaker array 1 has at least one pressure equalization channel 16*a*, 16*b*, where in this case the exemplary embodiment shown in FIG. 1 comprises a first and second pressure equalization channel 16*a*, 16*b*. The two pressure equalization channels 16*a*, 16*b* are formed in the printed circuit board 2. Both of them extend, starting from the second circuit board cavity 13, up to an outer side face 17*a*, 17*b* of the printed circuit board 2. At this outer face of the printed circuit board 2, in this case the side face 17*a*, 17*b*, each one of the pressure equalization channels 16*a*, 16*b* has an equalization opening 18*a*, 18*b* respectively. Therefore, in order to equalize the pressure, it is possible, when lowering the diaphragm 9, for the air to flow from the second circuit board cavity 13 through the pressure equalization channels 16*a*, 16*b* out of the printed circuit board 2. However, in an analogous manner it is also possible, when lifting the diaphragm 9, for the air to flow through the pressure equalization channels 16*a*, 16*b* into the second circuit board cavity 13. According to the exemplary embodiment shown in FIG. 1, the two through-flow channels 16*a*, 16*b* extend, in particular, coaxially to one another, in the transverse direction of the printed circuit board 2.

According to FIG. 1, the opening 14 of the second circuit board cavity 13 is formed on the outside of the printed circuit board 2, in this case the installation-oriented top side 19 of the printed circuit board 2. Therefore, in order to completely close this opening 14, the MEMS loudspeaker 3 is also arranged, according to FIG. 1, on the outside or, more specifically, the top side 19 of the printed circuit board 2. In this case the MEMS loudspeaker 3 is oriented with respect to the printed circuit board 2 in such a way that its second substrate opening 8 faces the printed circuit board 2. This arrangement allows the volume of the cavity 15 to be increased, since the cavity 15 also comprises now not only the second circuit board cavity 13, but also the substrate cavity 6.

The MEMS loudspeaker 3 may be bonded to the printed circuit board 2. However, in addition or as an alternative, said MEMS loudspeaker may also be connected, according to FIG. 1, by material bonding and/or in a form-fitting manner to the printed circuit board 2 by means of a protective layer 20. The protective layer 20 is formed on the top side 19 of the printed circuit board 2 and extends in the transverse direction of the loudspeaker array 1 up to the edge region 10 of the MEMS loudspeaker 3. This arrangement allows the MEMS loudspeaker 3 to be securely connected to the printed circuit board 2.

Furthermore, the loudspeaker array 1 comprises a sound-conducting channel 21, which extends on the side of the MEMS loudspeaker 3 that faces away from the second circuit board cavity 13 as far as up to an outer face of the loudspeaker array 1. On the outer face of the loudspeaker array 1, the sound-conducting channel 21 has an acoustic outlet opening 22.

Due to the fact that the ASIC 4 is designed so as to be integrated into the printed circuit board 2 and that the at least one part of the cavity 15 is designed so as to be integrated into the printed circuit board 2, the loudspeaker array 1 can be made very compact. Furthermore, the loudspeaker array 1 is very inexpensive to produce, especially since the printed circuit board 2 is constructed like a sandwich. Hence, the printed circuit board 2 comprises a plurality of layers 23 that are arranged one on top of the other and/or are connected to each other. For the sake of clarity only one of these layers is provided with a reference numeral. The layers 23 are securely connected to each other. Some of these layers 23 have at least one recess 24, by means of which the height of one of the circuit board cavities 11, 13 is formed at least partially.

In this context the layers 23 can be selected such that they are so thick that just a single layer has a corresponding height in order to form the respective circuit board cavity 11, 13. However, as an alternative, it is just as conceivable that a plurality of such layers 23, in particular, with a recess 24, which is identical in design and/or is arranged so as to be congruent to each other, are stacked one on top of the other, until the desired height for the respective circuit board cavity 11, 13 is reached.

According to FIG. 1, the first and second circuit board cavities 11, 13 are arranged one on top of the other. The printed circuit board 2 has at least one continuous layer, i.e., without a recess 24, in the region between the first circuit board cavity 11 and the second circuit board cavity 13, so that the two circuit board cavities 11, 13 are separated from each other.

FIGS. 2 to 7 show additional embodiments of the loudspeaker array 1, where in essence only the differences with respect to the embodiments that have already been described are discussed. Therefore, in the following description of the additional embodiments the same reference numerals are used for the same features. If these features are not explained again in detail, their design and mode of action correspond to the features already described above. The differences described below may be combined with the features of the exemplary embodiments described above and below respectively.

Figure 2:
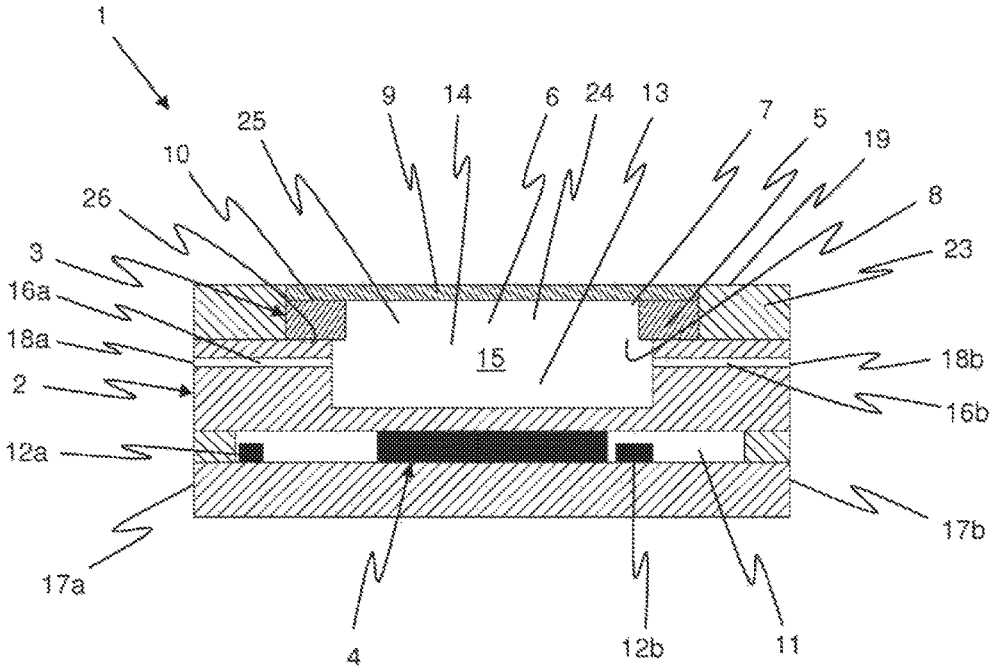

In contrast to the exemplary embodiment shown in FIG. 1, in the exemplary embodiment shown in FIG. 2, the MEMS loudspeaker 3 is additionally also integrated into the printed circuit board 2. For this purpose the printed circuit board 2 has a third circuit board cavity 25. This third circuit board cavity 25 is formed adjacent to and/or in accordance with the illustrated orientation of the loudspeaker array 1 above the second circuit board cavity 13. According to the present exemplary embodiment, the third circuit board cavity 25 has, compared to the second circuit board cavity 13, a greater width. This width corresponds more or less to the width of the MEMS loudspeaker 3. The MEMS loudspeaker 3 is disposed in the third circuit board cavity 25 and is consequently completely embedded in the printed circuit board 2.

Due to the differences in width between the second and third circuit board cavities 13, 25 in the transverse direction of the loudspeaker array 1, a projection 26 is formed between these two cavities, where in this case the position of the MEMS loudspeaker 3 in the printed circuit board 2 in the Z direction is determined by means of said projection 26.

The loudspeaker array 1 does not necessarily require a protective layer 20, as depicted in the exemplary embodiment shown in FIG. 1, since the MEMS loudspeaker 3 is positioned in a form-fitting manner in the printed circuit board 2 and is also held in a form-fitting manner downwards in the transverse direction. In order to be able to prevent the MEMS loudspeaker 3 from falling out of the third circuit board cavity 25, the MEMS loudspeaker 3 is glued into the third circuit board cavity 25 and/or is pressed with a force fit into said third circuit board cavity 25.

The third circuit board cavity 25 is formed by at least one additional layer 23 of the printed circuit board 2. In accordance with the above description the third circuit board cavity 25 can be formed in a manner analogous to the first and second circuit board cavities 11, 13 by a single layer 23, which has a recess 24. As an alternative, however, it is also possible to connect together several layers 23 having mutually congruent recesses 24 in such a way that said layers lie one on top of the other.

According to FIG. 2, the MEMS loudspeaker 3 sits flush with the top side 19 of the printed circuit board 2. As an alternative, however, the height of the third circuit board cavity 25 may also be designed so as to be greater than the height of the MEMS loudspeaker 3, so that the MEMS loudspeaker 3 is at a distance from the top side 19 of the printed circuit board 2.

Figure 3:
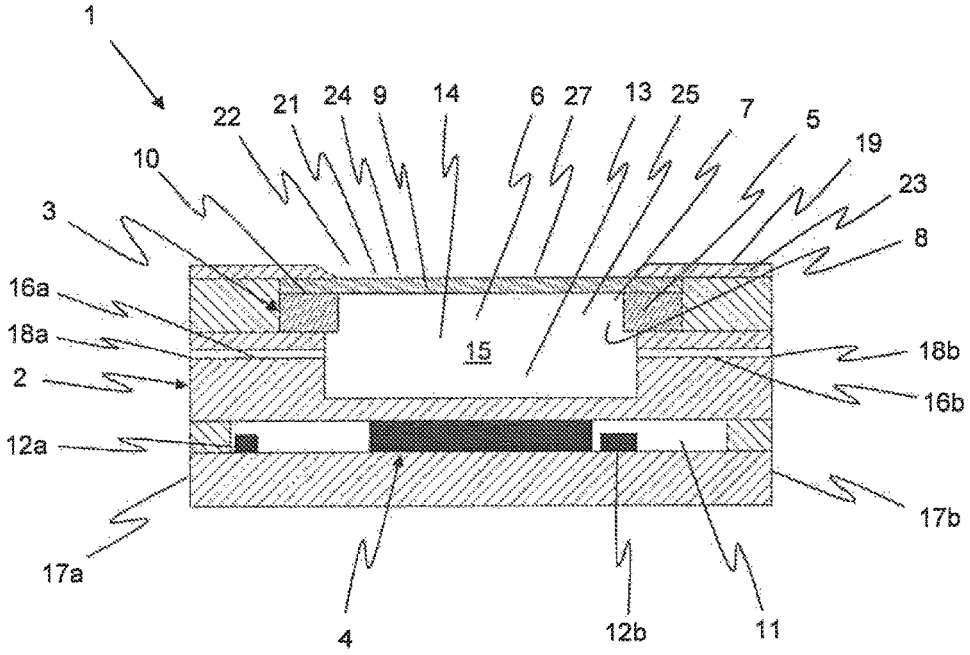

In addition to the exemplary embodiment shown in FIG. 2, the exemplary embodiment shown in FIG. 3 has a fourth circuit board cavity 27. The fourth circuit board cavity 27 is formed adjacent to and/or above the third circuit board cavity 25. Consequently the fourth circuit board cavity 27 is formed on a side of the third circuit board cavity 25 that faces away from the second circuit board cavity 13. As a result, the fourth circuit board cavity 27 forms the sound-conducting channel 21 of the loudspeaker array 1. According to the exemplary embodiment shown in FIG. 1, the sound-conducting channel 21 expands in the direction of the outer face of the printed circuit board 2. In the present case the sound-conducting channel 21, which is formed completely by the fourth circuit board cavity 27 of the printed circuit board 2, has a conical shape.

The fourth circuit board cavity 27 has, compared to the third circuit board cavity 25, a smaller width. Therefore, in comparison to the second and fourth circuit board cavities 13, 27, the third circuit board cavity 25 has a larger width. As a result, the MEMS loudspeaker 3 is enveloped in a form-fitting manner by means of the printed circuit board 2 in the edge region 10 of said MEMS loudspeaker. That being the case, the MEMS loudspeaker 3 is securely held by means of a form fit in the third circuit board cavity 25.

The second and fourth circuit board cavities 13, 27 are spaced apart from each other by means of the third circuit board cavity 25. Furthermore, these cavities 13, 27 are separated from each other by the MEMS loudspeaker 3, which is integrated into the third circuit board cavity 25.

In the exemplary embodiment shown in FIG. 3, the fourth circuit board cavity 27 is formed in a manner analogous to the first, second and third circuit board cavities 11, 13, 25 by means of at least one layer 23 of the printed circuit board 2, which has a correspondingly wide recess 24 for forming the fourth circuit board cavity 27. Of course, in the context of the foregoing description, it is also possible to arrange several layers 23 having corresponding recesses 24 one on top of the other, in order to form the fourth circuit board cavity 27.

According to the exemplary embodiment of the loudspeaker array 1 shown in FIGS. 1, 2 and 3, the MEMS loudspeaker 3 is oriented with respect to the printed circuit board 2 in such a way that the substrate cavity 6 and the second circuit board cavity 13 together form the cavity 15 of the MEMS loudspeaker 3. For this purpose the second substrate opening 8 is oriented toward the second circuit board cavity 13. As an alternative, however, the MEMS loudspeaker 3 may also be disposed in the printed circuit board 2 in such a way that it is rotated by 180°. According to the exemplary embodiment shown in FIG. 4, the MEMS loudspeaker 3 is oriented with respect to the printed circuit board 2 in such a way that the substrate cavity 6 forms together with the fourth circuit board cavity 27 the sound-conducting channel 21.

Figure 4:
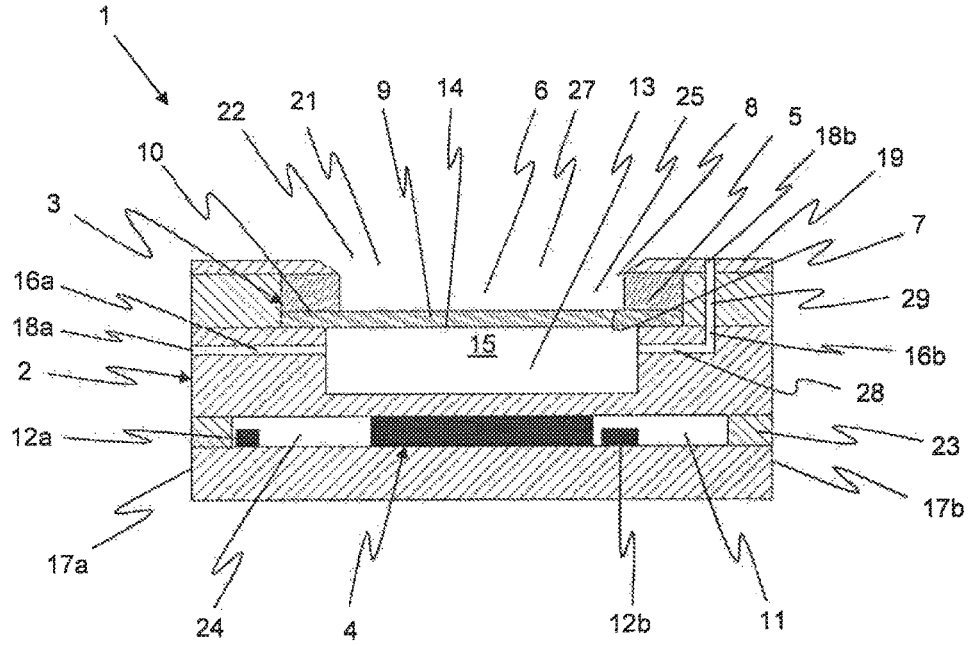

Another difference in the exemplary embodiment shown in FIG. 4 is that the second pressure equalization channel **16*b* does not extend from the second circuit board cavity 13 up to the side face 17*b*, but rather up to the top side 19 of the printed circuit board 2. For this purpose the second pressure equalization channel 16*b* has a first and second section 28, 29. The first section 28 is connected to the second circuit board cavity 13. The second section 29 has the equalization opening 18*b* on its end. The two sections 28, 29 are inclined with respect to each other at an angle of 90°. As an alternative, it is also conceivable that in order to emerge on the top side 19 of the printed circuit board 2, the pressure equalization channel 16*b*** is designed such that it is curved accordingly.

Figure 5:
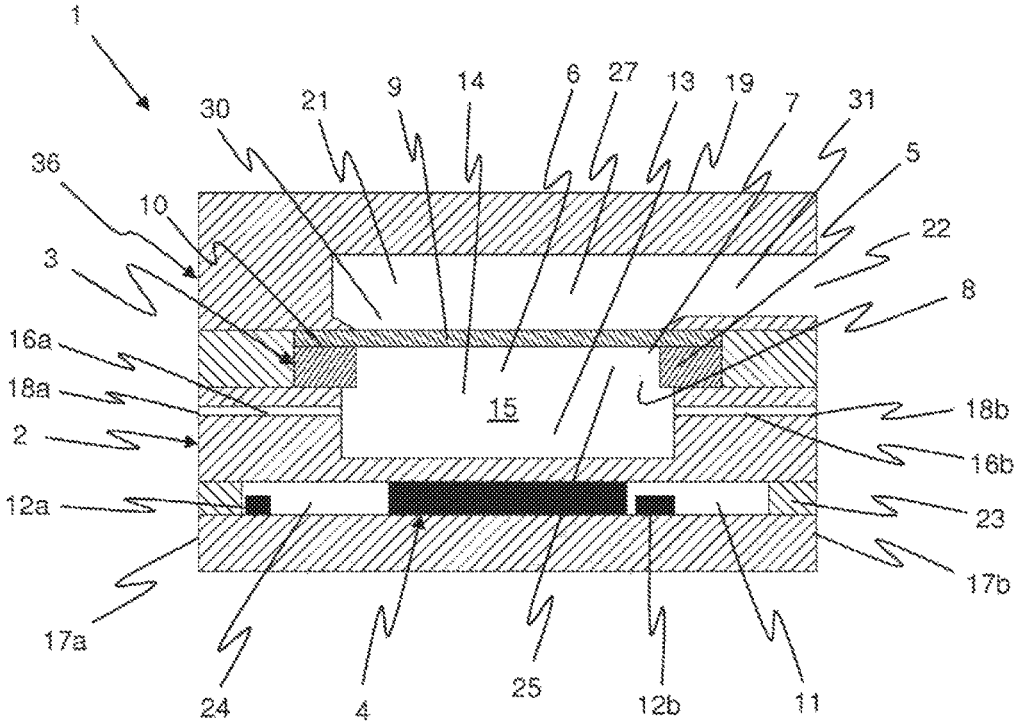

According to the exemplary embodiment shown in FIG. 5, the outlet opening 22 of the sound-conducting channel 21 may also be formed on a side face **17*b* of the printed circuit board 2. For this purpose the sound-conducting channel 21 or in accordance with the present exemplary embodiment, in particular, the fourth circuit board cavity 27 has a first region 30, which is adjacent to the MEMS loudspeaker 3, and a second region 31, which is adjacent to the outlet opening 22. The two regions 30, 31 are inclined with respect to each other in such a way that the sound, which is emitted upwards by the MEMS loudspeaker 3, is redirected to the side face 17***b* of the printed circuit board 2 and exits through the outlet opening 22 on the side of the printed circuit board 2. However, in an alternative exemplary embodiment that is not shown here, the sound-conducting channel 21 may also comprise only the region 31, which extends, according to FIG. 5, horizontally. In this case the sound-conducting channel 21 or, more specifically, the region 31, which extends at a 90°-angle to the Z axis, would be immediately adjacent to the MEMS loudspeaker 3. In addition or as an alternative, the fourth cavity 27 may also be formed in an add-on component 36, which is separate from the printed circuit board 2. Then this separate add-on component 36 is connected, in particular, glued to the printed circuit board 2. In this case the add-on component 36 comprises a material that is different from the material of the printed circuit board 2. Thus, according to FIG. 5, the ASIC 4 and the MEMS loudspeaker are integrated into or, more specifically, embedded in the printed circuit board 2; and/or the add-on component 36, which is separate from the printed circuit board 2, comprises at least partially, in the present case completely, the sound-conducting channel 21, preferably the first and/or second region(s) 30, 31.

Thus, according to the exemplary embodiment shown in FIG. 5, the sound-conducting channel 21 and/or the outlet opening 22 can be formed in the printed circuit board 2 or, as an alternative, in an add-on component 36 that is separate from the printed circuit board 2. The sound-conducting channel 21 extends at least partially at an angle to the Z axis of the MEMS loudspeaker 3, so that the sound waves, generated by the MEMS loudspeaker 3, are deflected by means of the sound-conducting channel 21. The outlet opening 22 is arranged on the side of the loudspeaker array 1, in particular, on a side face 17*b* that is inclined by 90° with respect to the Z axis.

Figure 6:
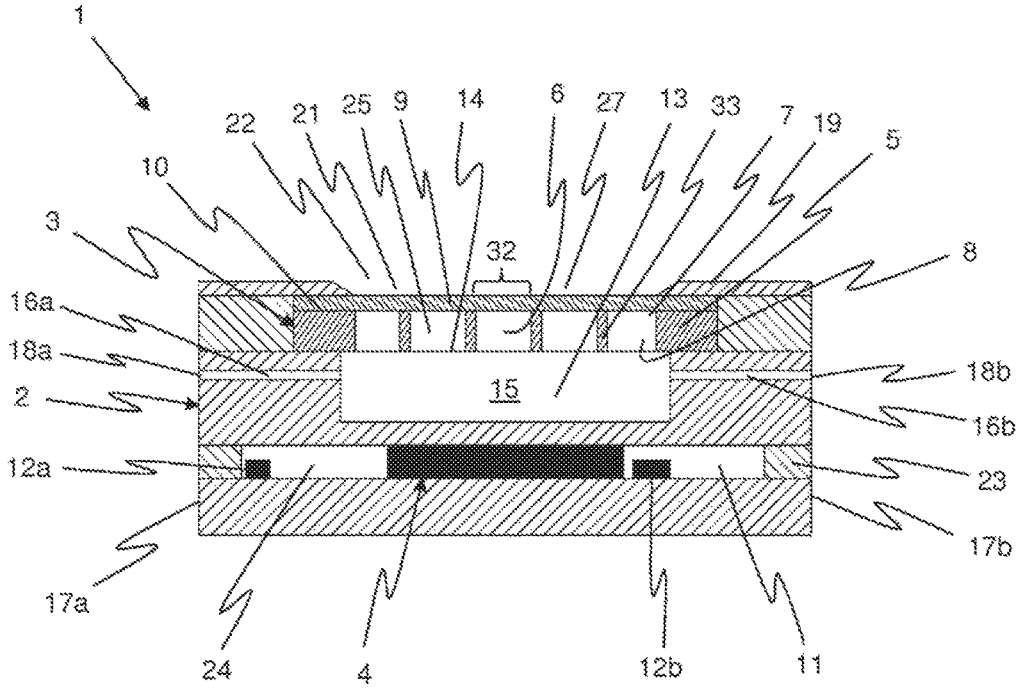

FIG. 6 shows the loudspeaker array 1 with an alternative embodiment of the MEMS loudspeaker 3. In this case the MEMS loudspeaker 3 is designed with a plurality of sound-generating diaphragm regions 32, only one of which is provided with a reference numeral for the sake of clarity. Each of these diaphragm regions 32 is assigned its own substrate cavity 6. The substrate cavities 6 are separated from each other by means of webs 33. According to the exemplary embodiment shown in FIG. 6, all of the substrate cavities 6 open into the common second circuit board cavity 13.

Figure 7:
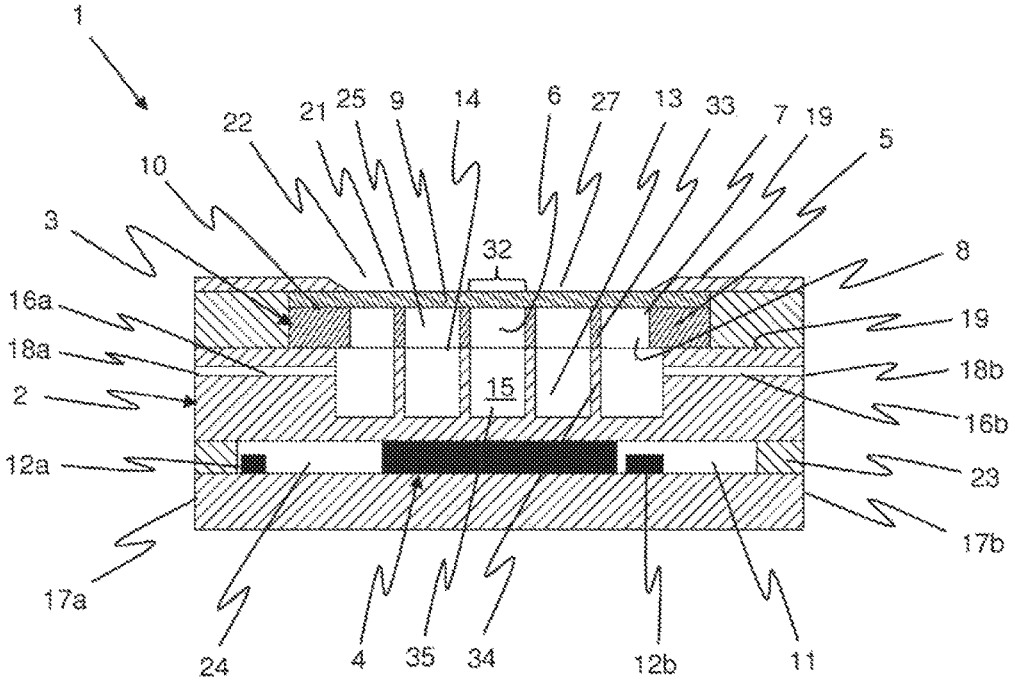

However, as an alternative, the second circuit board cavity 13 may also have, according to the exemplary embodiment shown in FIG. 7, a plurality of cavity regions 35. These cavity regions 35 are formed by means of the partition walls 34 that extend into the second circuit board cavity 13. In this case each of the cavity regions 35 is associated with a substrate cavity 6 of the MEMS loudspeaker 3. As a result, each of the partition walls 34 is aligned coaxially with a respective corresponding web 33.

With the exception of the first exemplary embodiment shown in FIG. 1, the MEMS loudspeaker 3 is totally integrated into the printed circuit board 2 in all of the other exemplary embodiments. In the case of the variants shown in FIGS. 3, 4, 5, 6 and 7, the MEMS loudspeaker 3 is also encompassed in a form-fitting manner from above.

The present invention is not limited to the illustrated and described exemplary embodiments. Modifications within the scope of the patent claims are just as possible as a combination of features, even if these features are shown and described in different embodiments.

LIST OF REFERENCE NUMERALS

1 loudspeaker array
2 printed circuit board
3 MEMS loudspeaker
4 ASIC
5 carrier substrate
6 substrate cavity
7 first substrate opening
8 second substrate opening
9 diaphragm
10 edge region
11 first circuit board cavity
12 additional passive components
13 second circuit board cavity
14 opening
15 cavity
16 pressure equalization channel
17 side face
18 equalization opening
19 top side
20 protective layer
21 sound-conducting channel
22 outlet opening
23 layer
24 recess
25 third circuit board cavity
26 projection
27 fourth circuit board cavity
28 first section
29 second section
30 first region
31 second region
32 diaphragm region
33 web
34 partition wall
35 cavity region
36 add-on component

The invention claimed is:

1. Loudspeaker array comprising:

a printed circuit board in which is defined a first circuit board cavity and a second circuit board cavity, wherein the first circuit board cavity is completely closed, the printed circuit board further defining a side face, the second circuit board defining an opening, the printed circuit board further defining a third circuit board cavity adjacent to the second circuit board cavity;

a MEMS loudspeaker that defines an edge region, the MEMS loudspeaker including a diaphragm deflectable along a Z axis for generating sound waves in the audible wavelength range and disposed with respect to the opening of the second circuit board cavity so that the second circuit board cavity forms at least a part of a cavity of the MEMS loudspeaker, which is disposed at least partially in said third circuit board cavity in such a way that the third circuit board cavity envelops the edge region of the MEMS loudspeaker in a form-fitting manner;

a sound-conducting channel, which is adjacent to the MEMS loudspeaker and extends at an angle to the Z axis of the MEMS loudspeaker and which has an acoustic outlet opening arranged on the side face of the printed circuit board; and an ASIC, which is disposed in the first circuit board cavity of the printed circuit board and completely integrated into the printed circuit board and electrically connected to the MEMS loudspeaker.

2. Loudspeaker array, as in claim 1, wherein the sound-conducting channel is inclined by 90° with respect to the Z axis.

3. Loudspeaker array, as in claim 1, wherein the Z axis is aligned parallel to the side face, and the sound-conducting channel is inclined by 90° with respect to the Z axis.

4. Loudspeaker array, as in claim 1, wherein the first and second circuit board cavities are arranged side by side or one on top of the other and/or are separated from each other.

5. Loudspeaker array, as in claim 1, wherein the sound-conducting channel includes a first region, which is adjacent to the MEMS loudspeaker, wherein the sound-conducting channel comprises a second region, which is adjacent to the outlet opening; and said first and second regions are inclined with respect to each other at an angle.

6. Loudspeaker array, as in claim 5, wherein the angle is 90°.

7. Loudspeaker array, as in claim 1, wherein the MEMS loudspeaker defines a side facing away from the second circuit board cavity and a side facing toward the second circuit board cavity, wherein the MEMS loudspeaker is integrated into the printed circuit board in such a way that the third circuit board cavity envelops in a form-fitting manner the MEMS loudspeaker in its edge region of its side facing away from the second circuit board cavity.

8. Loudspeaker array, as in claim 1, wherein the MEMS loudspeaker defines a side facing away from the second circuit board cavity and a side facing toward the second circuit board cavity, wherein the MEMS loudspeaker is integrated into the printed circuit board in such a way that the third circuit board cavity envelops in a form-fitting manner the MEMS loudspeaker in its edge region of its side facing toward the second circuit board cavity.

9. Loudspeaker array, as in claim 1, wherein the sound-conducting channel is arranged adjacent to the third circuit board cavity.

10. Loudspeaker array, as in claim 1, wherein the printed circuit board defines a fourth circuit board cavity, and the sound-conducting channel is formed at least partially by the fourth circuit board cavity.

11. Loudspeaker array, as in claim 1, wherein the printed circuit board defines a fourth circuit board cavity, the sound-conducting channel is arranged adjacent to the third circuit board cavity and is formed at least partially by the fourth circuit board cavity.

12. Loudspeaker array, as in claim 10, wherein the fourth circuit board cavity defines a funnel shape, wherein the width of the fourth circuit board cavity becomes larger in at least in regions starting from the MEMS loudspeaker in the direction of the outlet opening.

13. Loudspeaker array, as in claim 10, wherein the second circuit board cavity and the fourth circuit board cavity are spaced apart from one another by means of the third circuit board cavity.

14. Loudspeaker array, as in claim 10, wherein the second circuit board cavity and the fourth circuit board cavity are spaced apart from one another by means of the MEMS loudspeaker integrated therein.

15. Loudspeaker array, as in claim 10, wherein the second circuit board cavity and the fourth circuit board cavity are spaced apart from one another by means of the third circuit board cavity and by means of the MEMS loudspeaker integrated therein.

16. Loudspeaker array, as in claim 10, wherein the printed circuit board is constructed like a sandwich of several layers, which are connected to each other and of which at least one layer has a first recess, by means of which the first circuit board cavity is formed at least partially, and the printed circuit board has at least one layer defining a second recess, by means of which at least one of the second, third and fourth circuit board cavities is formed at least partially.

17. Loudspeaker array comprising:

a printed circuit board in which is defined a first circuit board cavity and a second circuit board cavity, the printed circuit board further defining an outer face, the second circuit board cavity defining an opening and the first circuit board cavity being completely closed;

a MEMS loudspeaker, which has a diaphragm deflectable along a Z axis for generating sound waves in the audible wavelength range and disposed with respect to the opening of the second circuit board cavity so that the second circuit board cavity forms at least a part of a cavity of the MEMS loudspeaker;

an ASIC, which is disposed in the first circuit board cavity of the printed circuit board and completely integrated into the printed circuit board and electrically connected to the MEMS loudspeaker; and wherein the printed circuit board defines at least one pressure equalization channel, which is integrated therein and extends, starting from the second circuit board cavity, up to the outer face of the printed circuit board and defines an opening in the outer face.

18. Loudspeaker array, as in claim 17, wherein the pressure equalization channel has a first section, which is connected to the second circuit board cavity, and a second section, which is connected to the equalization opening, and both the first and second sections are inclined with respect to each other.

* * * * *